US006125245A

United States Patent [19]

Shibuya et al.

[11] Patent Number: 6,125,245

[45] Date of Patent: Sep. 26, 2000

[54] IMAGE FORMING APPARATUS

[75] Inventors: Takashi Shibuya, Shizuoka-ken; Yoichiro Maebashi, Numazu, both of Japan

[73] Assignee: Canon Kabushiki Kaisha, Tokyo, Japan

[21] Appl. No.: 09/286,444

[22] Filed: Apr. 6, 1999

[30] Foreign Application Priority Data

Apr. 9, 1998 [JP] Japan ..... 10-114273

[51] Int. Cl.[7] ..... G03G 15/00

[52] U.S. Cl. ..... 399/49; 399/50; 399/55

[58] Field of Search ..... 399/46, 49, 50, 399/53, 55

[56] References Cited

U.S. PATENT DOCUMENTS 4,647,184 3/1987 Russell et al. ..... 399/49 X
5,266,997 11/1993 Nakane et al. ..... 399/49
5,315,352 5/1994 Nakane et al. ..... 399/49
5,400,120 3/1995 Narazaki et al. ..... 399/46 X
5,666,588 9/1997 Uchiyama et al. ..... 399/44
5,822,079 10/1998 Okuno et al. ..... 399/49 X
5,873,010 2/1999 Enomoto et al. ..... 399/39
5,940,650 8/1999 Inama et al. ..... 396/440

*Primary Examiner*—Sandra Brase
*Attorney, Agent, or Firm*—Fitzpatrick, Cella, Harper & Scinto

[57] ABSTRACT

An image forming apparatus is constructed by: an image bearing member, a charging unit, a developing unit, and a density detecting unit, and densities of developer images as electrostatic latent images formed by changing the charging voltage and the developing voltage are detected by the density detecting unit and, on the basis of detection results, a charging voltage which is applied to the charging unit and a developing voltage which is applied to the developing unit are determined when an image is formed.

7 Claims, 9 Drawing Sheets

IMAGE FORMING APPARATUS

BACKGROUND OF THE INVENTION

1. Field of the Invention

The invention relates to an image forming apparatus of an electrophotographic system such as a copying machine, laser beam printer, or the like.

2. Related Background Art

As an image forming apparatus, FIG. 8 shows a schematic construction of an example of a multicolor image forming apparatus for forming a color image by using an intermediate transfer member. The multicolor image forming apparatus is a copying machine or a laser beam printer using an electrophotographic process. The construction and the operation of the image forming apparatus will now be simply explained hereinbelow.

As shown in FIG. 8, an electrophotographic photosensitive member (photosensitive drum) 1 of a rotary drum type serving as an image bearing member is arranged in a main body of the image forming apparatus. The photosensitive drum 1 is rotated at a predetermined peripheral speed (processing speed) in a direction shown by an arrow R1. In the rotating step, the surface of the photosensitive drum 1 is charged to a predetermined electric potential of a predetermined polarity by a charging unit 2 such as a corona discharging unit or the like. The charged surface of the drum 1 is subjected to an image exposure L by an exposing device 3 (an image formation exposure optical system based on a color separation of a color original image, a scanning exposure optical system by a laser scanner to generate a laser beam modulated in correspondence to a time sequential electric digital image signal of image information). Thus, an electrostatic latent image corresponding to a color separation image of a first color, for example, a magenta component image of a target color image is formed.

Subsequently, the latent image is developed by, for example, a first developing unit (magenta developing unit) 4*a* among four developing units 4 using magenta toner (colored charging particles of magenta) and is visualized as a magenta toner image. The magenta toner image formed on the photosensitive drum 1 is transferred onto the surface of an intermediate transfer drum 50 serving as an intermediate transfer member.

The intermediate transfer drum 50 is constructed by forming an elastic layer 52 of a middle resistance onto a conductive base layer 51 and by further forming a mold releasing layer onto the elastic layer 52. As an intermediate transfer member, a belt-shaped drum can be used in addition to a drum shape like an intermediate transfer drum 50.

The intermediate transfer drum 50 comes into contact with the photosensitive drum 1 and is rotated in a direction shown by an arrow R2 at the same speed as that of the photosensitive drum 1. At the time of the transfer, a primary transfer bias of a polarity (plus) opposite to a toner charging polarity (minus in this example) of the toner image on the photosensitive drum 1 is applied to the base layer 51 by a primary transfer bias power source 61. The magenta toner image of the first color formed on the photosensitive drum is transferred onto the surface of the intermediate transfer drum 50 by applying the transfer bias (primary transfer).

After completion of the transfer of the toner image, the surface of the photosensitive drum 1 is cleaned by a cleaning device 14, thereby removing the transfer residual toner remaining on the surface.

Similarly, the charging is performed to the photosensitive drum 1, the image exposure L corresponding to a color component image of the second color, for example, cyan component image, and the development of an electrostatic latent image by a second developing unit 4*b* (cyan developing unit) are performed, thereby obtaining a cyan toner image of the second color. The obtained cyan toner image is transferred onto the magenta toner image formed on the surface of the intermediate transfer drum 50. The surface of the photosensitive drum 1 to which the cyan toner image was transferred is cleaned by the cleaning device 14.

In a manner similar to the above, with respect to the third and fourth colors, for example, yellow and black, the image exposure L to the photosensitive drum 1, the development of electrostatic latent images by a third developing unit 4*c* (yellow developing unit) and a fourth developing unit 4*d* (black developing unit), and an overlap transfer of obtained yellow toner image and black toner image onto the surface of the intermediate transfer drum 50 are performed.

By sequentially executing the forming and transferring processes of the toner images of four colors as mentioned above, a color toner image (having a mirror image relation with an original color image) in which the toner images of four colors of magenta, cyan, yellow, and black were overlapped is formed as a synthetic color image corresponding to a target color image onto the surface of the intermediate transfer drum 50.

One transfer material (paper) P is taken out from a sheet feeding cassette 9 and is conveyed. The transfer material P is fed to a transfer unit formed by a transfer charging unit (corona charging unit) 7 and the intermediate transfer drum 50 at a predetermined timing through a registration roller pair 11 and a transfer guide 12.

By applying a transfer bias of a plus polarity opposite to the charging polarity of the toner to the transfer charging unit 7 by a secondary transfer bias power source 71, the toner images of four colors on the intermediate transfer drum 50 are transferred onto the surface of the transfer material P in a lump while the transfer material P passes through a transfer portion (secondary transfer).

The transfer material P to which the toner images of four colors were transferred is led to a fixing unit 15 from the intermediate transfer drum 50 via a conveying guide 13. In the fixing unit 15, the toner images of four colors are heated and pressed and subjected to a fixing process by a fixing roller 16 heated to a predetermined temperature and a fixing roller 17 which comes into pressure contact with the fixing roller 16. A final full color image is formed and, after that, the transfer paper is discharged to the outside of the image forming apparatus.

After completion of the transfer of the toner images, the transfer residual toner remaining on the surface of the intermediate transfer drum 50 is cleaned and removed by a cleaning device 8. The cleaning device 8 is arranged so as to freely come into contact with and removed from the intermediate transfer drum 50. When the transfer of the toner images of the intermediate transfer drum 50 is finished, the cleaning device is removed from a normal separate state to an operative state where the transfer paper is in contact with the surface of the intermediate transfer drum 50.

To keep a density of the color image on the transfer material P at a desired predetermined density, a density sensor is arranged near the photosensitive drum 1. For example, when a power source of the image forming apparatus main body is turned on or when a predetermined number of images are formed or the like, a plurality of patch patterns of a predetermined size and each color are formed as toner images onto the photosensitive drum 1 by changing an image forming condition such as a developing bias. A density of the patch of each color is detected by the density sensor, thereby obtaining the image forming condition to realize the optimum density from a change in density of the patch. A density control to change to such a condition is performed.

Although the patch patterns are dither patterns in many cases, the other various patterns are also used. There is also a method whereby a density sensor is arranged near the intermediate transfer drum 50 and the density of the patch transferred onto the intermediate transfer drum is read, thereby performing the density control.

However, when the above density control is performed, there is a case where the following problems occur.

When a multicolor image in which image portions of different colors are arranged is formed after completion of the density control, there is a case where a phenomenon (white gap) such that although no gap exists in adjacent boundary portions of image portions which are neighboring on image data, it seems as if a white line existed there occurs.

For example, FIG. 9 shows a state of a case where an image portion Qm of magenta and an image portion Qc of cyan are arranged in parallel and formed. According to the ideal image data, the image portions Qm and Qc should be neighboring without any gap as shown in FIG. 9A. However, a gap q due to the white gap is formed at a boundary between them as shown in FIG. 9B.

This phenomenon also occurs in a portion where image portions of different colors and arbitrary shapes are neighboring without being limited to the case where the rectangular image portions of different colors are adjacent as mentioned above. In a natural image, graph chart, or the like, when a white line due to the white gap appears, an image quality remarkably deteriorates.

As another problem, a fogged image on background or the like occurs because characteristics of developers of developing units, particularly, color developing units (developing units 4*a*, 4*b*, and 4*c* of magenta, cyan, and yellow) are changed in association with the image formation. When the fogged image on background is generated, the image is formed as if the whole image became dirty and the image quality is also remarkably deteriorated.

The above various phenomena are caused due to a potential contrast (contrast potential, back contrast potential) between a latent image potential (dark portion potential, light portion potential) on the surface of the photosensitive drum where the image formation is performed and a developing potential, an aging change in an environment of the developers, an aging change due to the use for a long period of time, and further, a developing system. Generally, the white gap occurs when the back contrast potential is large and the fogged image on background occurs when the back contrast potential is small.

SUMMARY OF THE INVENTION

It is an object of the invention to provide an image forming apparatus which can properly decide a charging voltage to be applied to charging means at the time of image formation and a developing voltage to be applied to developing means.

Another object of the invention is to provide an image forming apparatus which can stably obtain an image of a high quality without a white gap and a fogged image on background by properly controlling image forming conditions in a density control.

The above and other objects and features of the present invention will become apparent from the following detailed description and the appended claims with reference to the accompanying drawings.

DETAILED DESCRIPTION OF THE PREFERRED EMBODIMENTS

Embodiments of an image forming apparatus of the invention will now be described in detail hereinbelow with reference to the drawings.

Embodiment 1

FIG. 1 is an explanatory diagram showing a density control method in an embodiment of an image forming apparatus.

The invention is characterized in that in a multicolor image forming apparatus, in addition to a developing bias, a primary charging bias is changed as an image forming condition in an interlocking relation. A fundamental construction of the image forming apparatus of the invention is substantially the same as the foregoing image forming apparatus shown in FIG. 8. An explanation will now be made hereinbelow referring to FIG. 8 as necessary.

In the embodiment, the image forming apparatus is constructed in a color laser printer as a multicolor image forming apparatus and a printing speed is equal to 3 ppm (papers per minute) in the case of the color copy of the A3 size and to 6 ppm in the case of the color copy of the A4 size.

Figure 8:
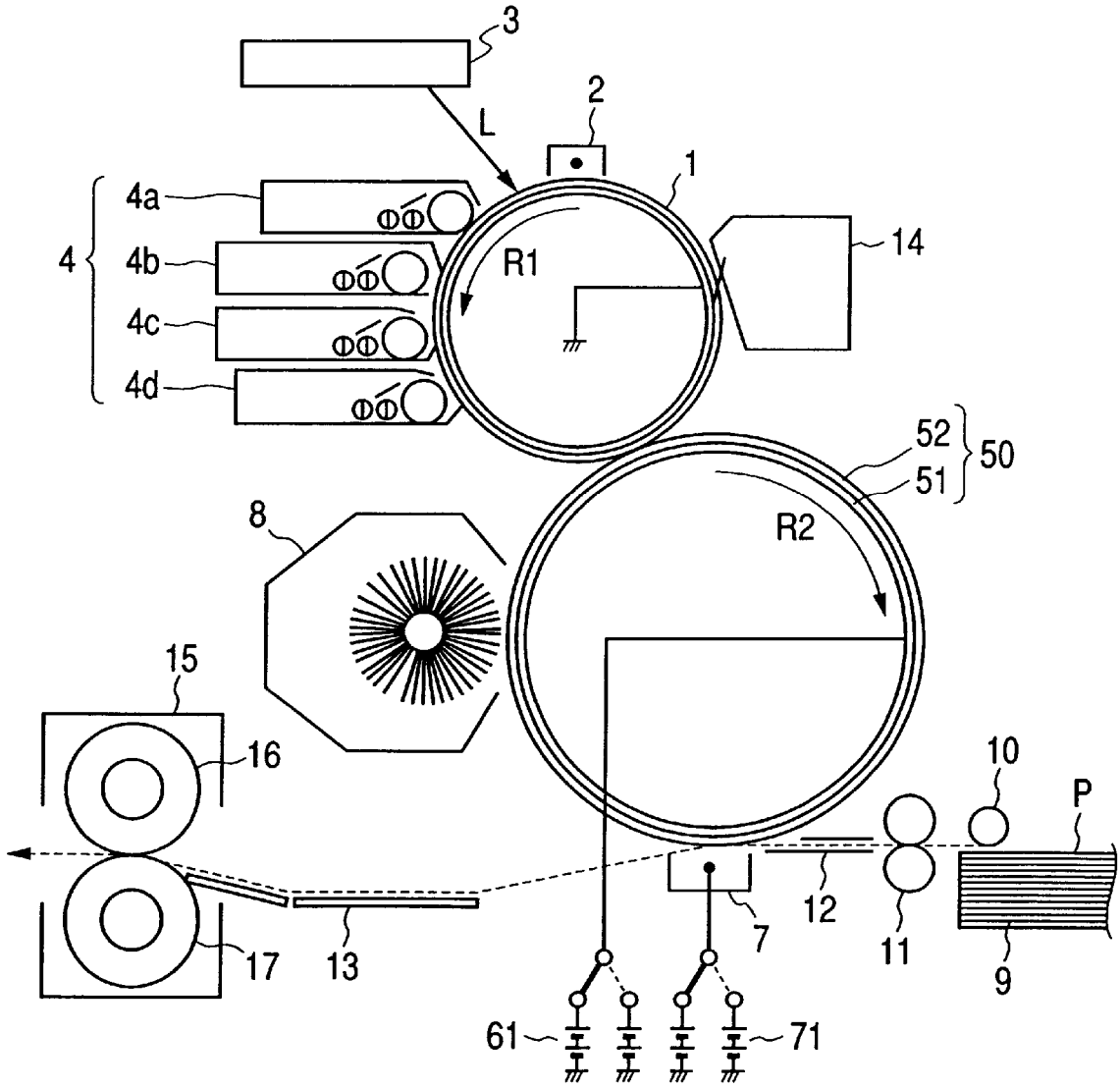
FIG. 8 is a schematic diagram showing an image forming apparatus.
Figure 9A:
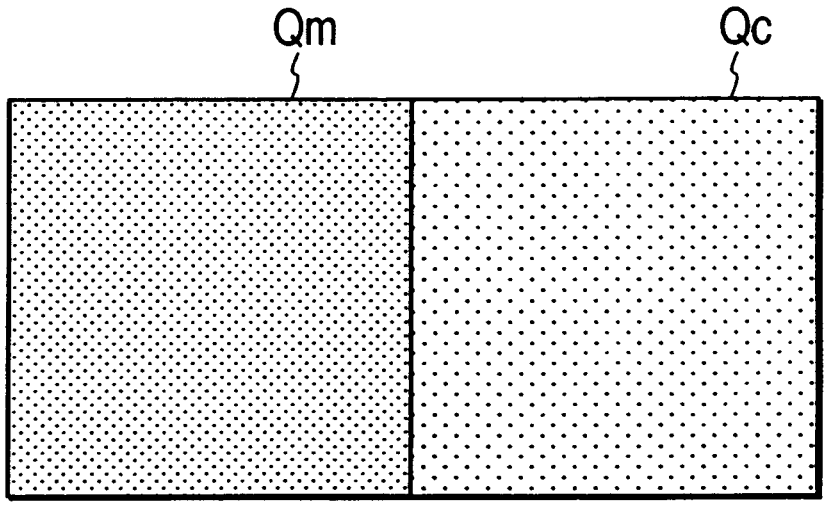
FIGS. 9A and 9B are explanatory diagrams showing a situation such that a white gap is caused in a boundary portion of adjacent image portions of different colors by a multicolor image formation after completion of a density control by the image forming apparatus of FIG. 8.
Figure 9B:
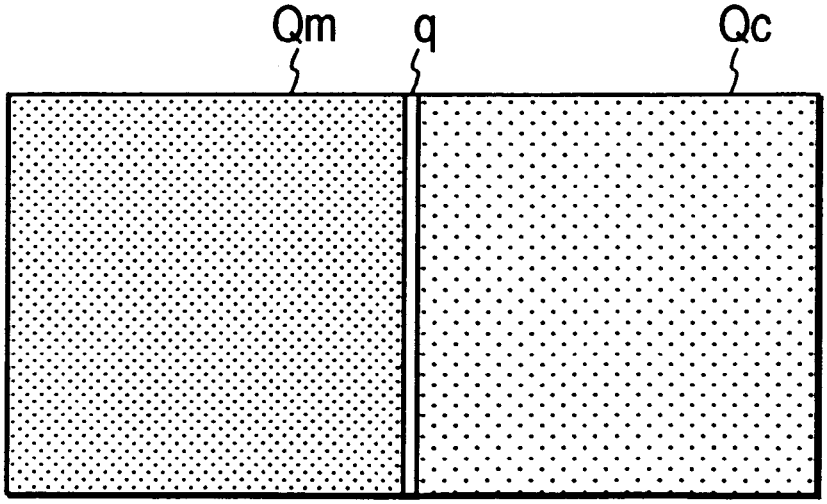

A primary charging bias is applied to the charging unit 2 in FIG. 8 by a primary charging power source (not shown). The surface of the photosensitive drum 1 which rotates in the direction shown by the arrow R1 is primary charged to a predetermined primary charging potential Vd by the charging unit 2. In the embodiment, it is charged to Vd of −600V.

Subsequently, the drum surface is subjected to the image exposure L of a laser beam emitted in accordance with image data by the exposing device 3, so that an electrostatic latent image is formed on the surface of the photosensitive drum 1. An electric potential (exposure potential V1) at the exposed portion of the latent image is equal to about −200V.

The latent image is developed by the developing units 4 (4*a* to 4*d*). At the time of development, a developing bias is applied to a developing sleeve of each developing unit 4. The toner is adhered to the latent image on the photosensitive drum 1 by a force of an electric field, so that the latent image is developed. In the embodiment, a developing bias Vdev (DC voltage component of the developing bias) is set to about −350V. The latent image is visualized as a toner image by the development.

A voltage difference between the potential V1 at the exposed portion and the developing bias Vdev is referred to a contrast potential Vcont. A voltage difference between the primary charging potential (primary charging bias) Vd and the developing bias Vdev is referred to a back contrast potential Vback. In the above embodiment, Vcont is set to 150V and Vback is set to 250V.

In the image forming apparatus, the developing bias Vdev can be changed in a range from −150V to 550V. Therefore, even under various conditions, a developing bias which satisfies a sufficient density can be selected.

Figure 2:
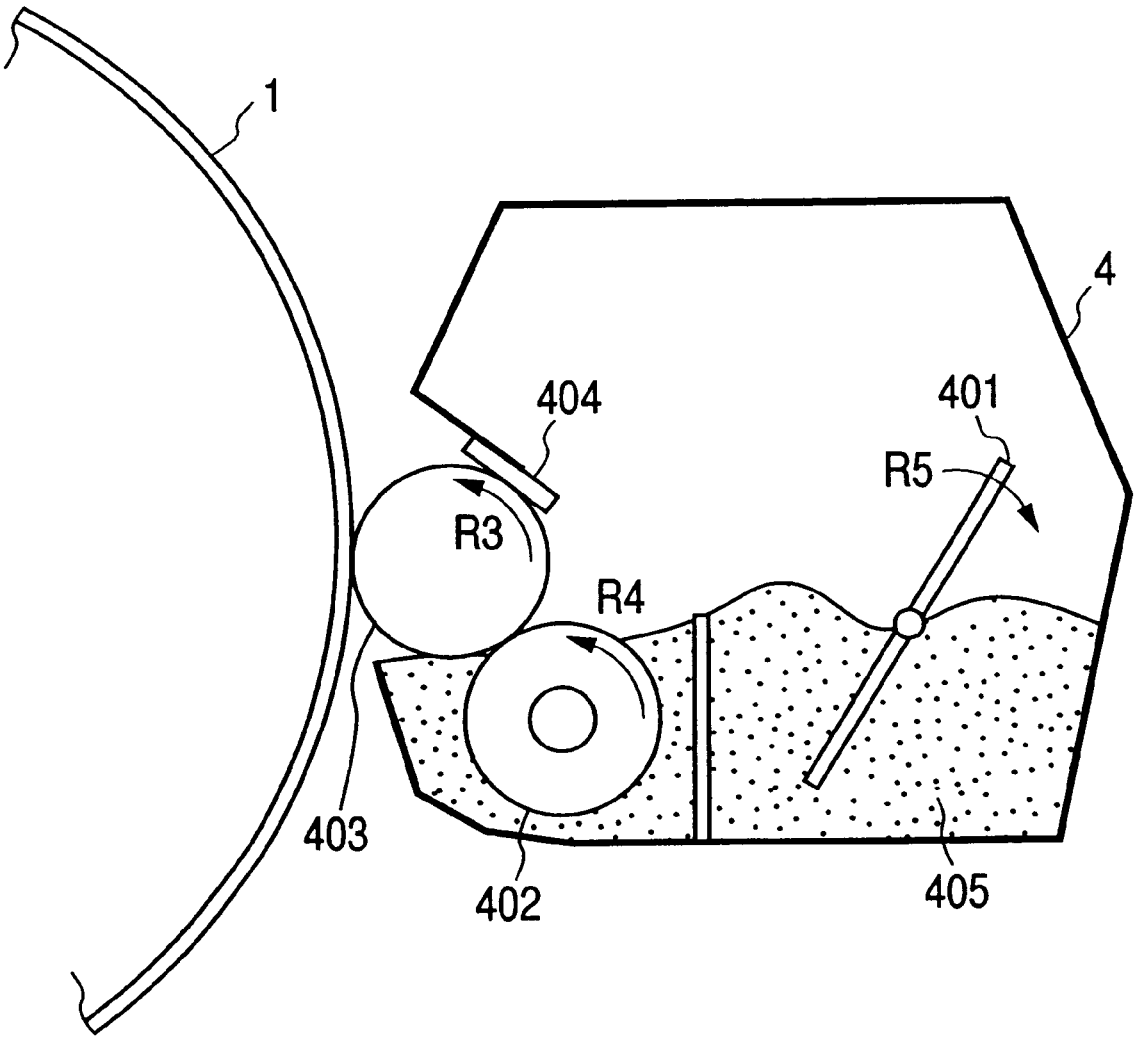
FIG. 2 is a schematic diagram showing an example of a developing unit which is used in the image forming apparatus of the invention.

FIG. 2 shows the developing unit used in the embodiment. The developing unit 4 shown in FIG. 2 uses a nonmagnetic one component contactless development system and nonmagnetic toner 405 is contained in the developing unit. A developing sleeve 403 which rotates in the direction shown by an arrow R3 is arranged in an opening portion which faces the photosensitive drum 1 of the developing unit 4 so as to face the photosensitive drum 1 with a predetermined interval between the developing sleeve 403 and photosensitive drum 1. A foamed sponge roller 402 which rotates in the direction of an arrow R4 while being in contact with the developing sleeve 403 is arranged at an oblique lower position of the developing sleeve 403. A developing blade 404 serving as a developer regulating member is arranged in an almost top portion of the developing sleeve 403 while being in contact therewith.

The nonmagnetic toner 405 contained in the developing unit 4 is fed to the sponge roller 402 while being stirred by an agitating blade 401 which rotates in the direction of an arrow R5. The toner 405 fed to the sponge roller 402 is supplied to the developing sleeve 403 by its rotation and is borne on the developing sleeve 403. The toner 405 held on the developing sleeve 403 is conveyed toward a developing area which faces the photosensitive drum 1 by the rotation of the developing sleeve 403 and is restricted by the developing blade 404 during conveyance. Frictional charging charges (triboelectricity) are given to the toner and the resultant toner is formed in a thin toner layer onto the developing sleeve 403.

The toner 405 conveyed to the developing area develops the latent image on the photosensitive drum 1 by the operation of the developing bias (DC voltage+AC voltage) applied to the developing sleeve 403 at a position between the sleeve 403 and drum 1, thereby visualizing the image.

The toner which is not used for the development is returned into the developing unit 4 in association with the rotation of the developing sleeve 403 and, after that, it is removed from the surface of the developing sleeve 403 by the sponge roller 402 and is collected into the developing unit 4.

The image forming apparatus executes a density control at a predetermined timing, for example, when a power source of the image forming apparatus main body is turned on, when a predetermined number of images are formed, or the like.

Hitherto, the density control is performed by a method whereby a patch pattern of each color is formed as a toner image onto the intermediate transfer drum 50 while changing the developing bias, a density of the patch of each color is detected by a density sensor, the developing bias to realize the optimum density is obtained from a change state of the patch density, and the operating condition of the apparatus is changed to such a condition.

That is, hitherto, the density control is performed by mainly obtaining a contrast potential. This means that the developing bias is obtained and nothing is considered with respect to the primary charging bias.

The invention is characterized in that the primary charging bias is changed in a predetermined interlocked relation with the developing bias at the time of the density control. In the embodiment, the primary charging bias is changed in an interlocked relation with the developing bias so that the back contrast potential is always set to 150V.

Figure 1A:
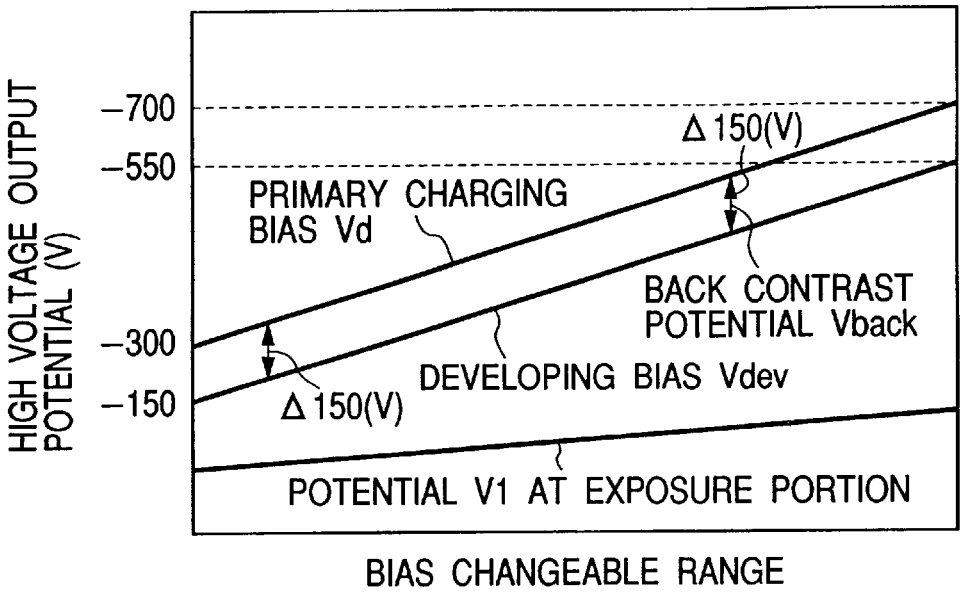
FIGS. 1A and 1B are explanatory diagrams showing a density control method in an embodiment of an image forming apparatus and a conventional density control method.
Figure 1B:
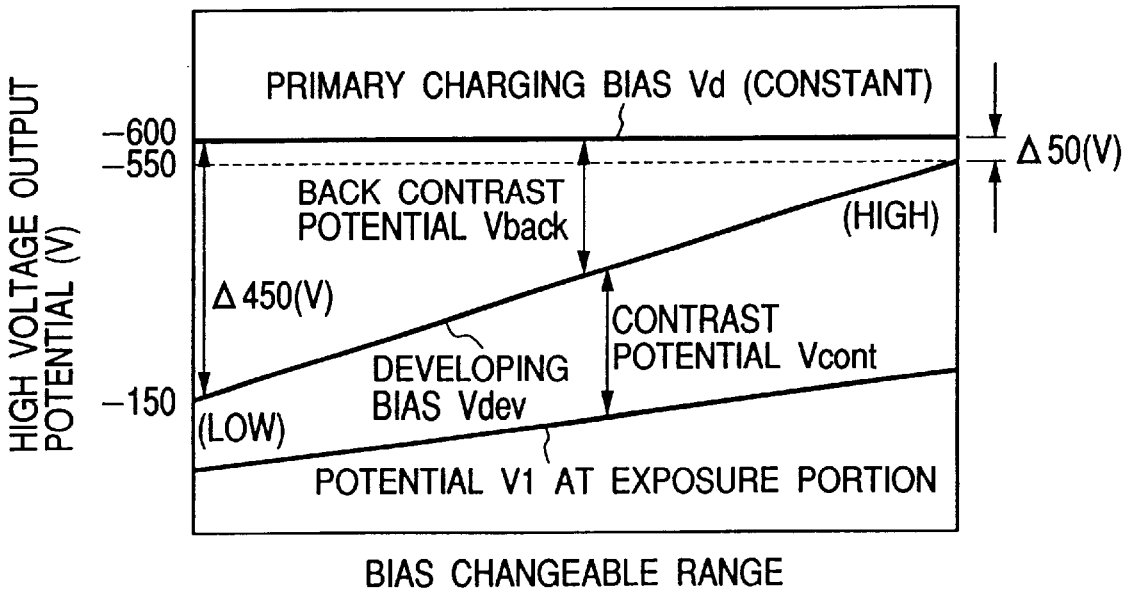

In an explanatory diagram showing a density control method of the embodiment, FIG. 1A shows a relation between the primary charging bias and the developing bias according to the embodiment and FIG. 1B shows a relation between the conventional primary charging bias and the developing bias.

As shown in FIG. 1B, hitherto, since the primary charging bias Vd has been set to a predetermined value of −600V upon density control, it will be understood that when the developing bias Vdev is changed from a low bias side of −150V to a high bias side of −550V, the back contrast potential Vback largely changes to a value in a range from 450V to 50V.

As mentioned above, when the density control is performed, since the developing bias is changed due to it, the back contrast potential also largely fluctuates. Particularly, under an environment of a high temperature and high humidity (30° C., 80% RH) or the like, since a sufficient density can be satisfied by the low contrast potential Vcont of 50V, a solid density can be sufficiently satisfied by the developing bias Vdev of −200V. However, since the back contrast potential rises to 400V, if the multicolor image formation is performed under this condition, a clear white line due to a white gap appears in the boundary portion of the adjacent image portions of different colors.

On the other hand, according to the embodiment, as compared with the primary charging voltage of −300V and the potential at the exposed portion of −100V, the developing bias is equal to −150V and the same contrast potential of 50V as that mentioned above is assured. That is, by changing the primary charging bias in an interlocked relation with the developing bias, the density control is performed while maintaining the back contrast potential of 150V. Therefore, when the multicolor image formation is performed under this condition, a multicolor image with an extremely high quality in which a white line due to the white gap is not generated in the boundary portion between the adjacent image portions of different colors can be obtained.

To obtain an enough density under an environment of a low temperature and a low humidity (15° C., 10% RH), a contrast potential of a certain degree is needed. Therefore, in many cases, the developing bias is controlled to a slightly high value due to the density control.

Hitherto, when the developing bias is set to −450V or higher, since the back contrast potential is equal to or less than 50V, the generation of a fogged image on background is gradually started and the image quality is gradually deteriorated.

In the embodiment, since the back contrast potential is maintained at 150V, even if the developing bias is changed to the maximum changeable width, no fogged image on the background is generated.

As described above, since the primary charging bias is changed in an interlocked relation with the developing bias upon density control so as to have a relation such that the back contrast potential is equal to 150V, the white gap can be avoided and, at the same time, the fogged image on background can also be suppressed.

Although the back contrast potential has been set to 150V in the above example, the invention is not limited to such an embodiment. The back contrast potential can be also set to an arbitrary value so long as it is the optimum value. Further, in the invention, the developing unit 4 is not limited to the nonmagnetic one component contactless development system.

Embodiment 2

The embodiment 2 is characterized in that the process to change the primary charging bias in an interlocked relation with the developing bias is performed while making it different in accordance with an environmental condition.

Figure 3:
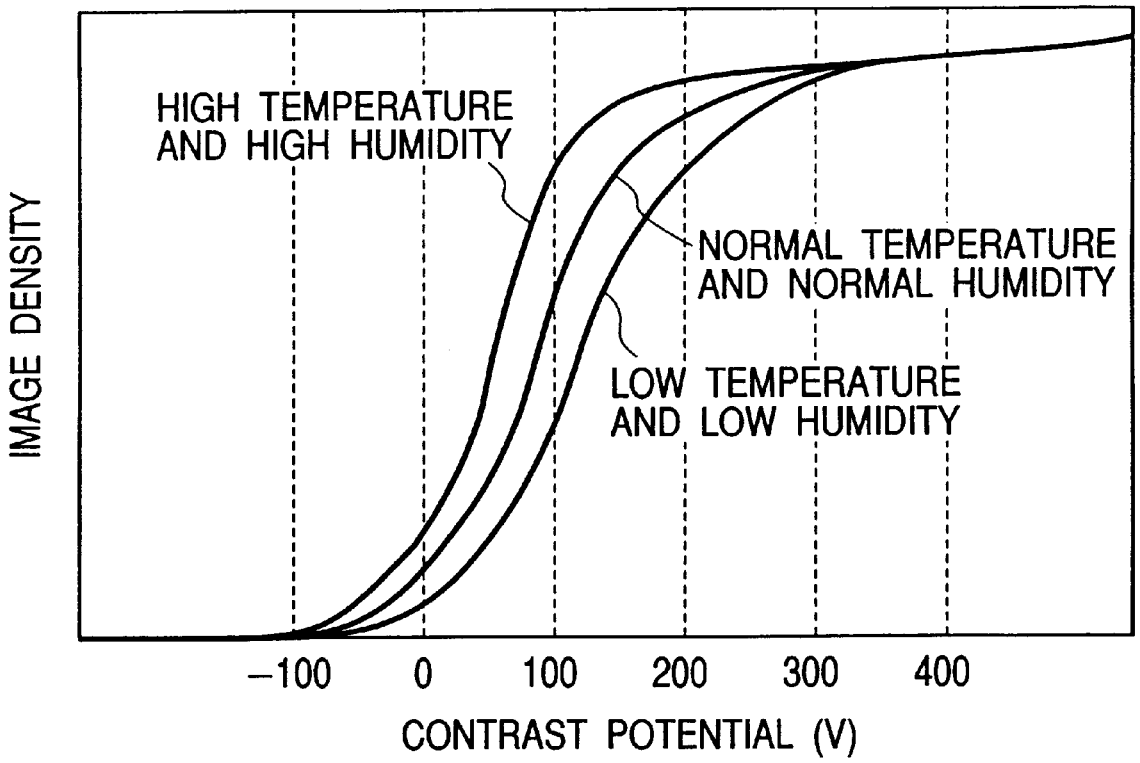
FIG. 3 is an explanatory diagram showing dependency on an environment of developing characteristics serving as a base of a control performed in another embodiment of the invention.

The generation of the white gap and the fogged image on background mainly depends on the developing characteristics and the developing characteristics are largely influenced by an environmental atmosphere where the image formation is performed. FIG. 3 shows dependency on the environment of the developing characteristics.

Generally, under a high temperature and a high humidity, even if the contrast potential is set to a low value, the image is sufficiently developed and a solid density is satisfied. Further, when the back contrast potential decreases, the fogged image on background is likely to occur. On the contrary, under an environment of a low temperature and a low humidity, a certain degree of contrast potential is necessary and, further, even if the back contrast potential is slightly small, the fogged image on background is unlikely to occur.

According to the embodiment, by returning the environmental characteristics as mentioned above for the interlocking relation between the primary charging bias and the developing bias, the optimum image forming conditions are selected in accordance with the environment.

Figure 4:
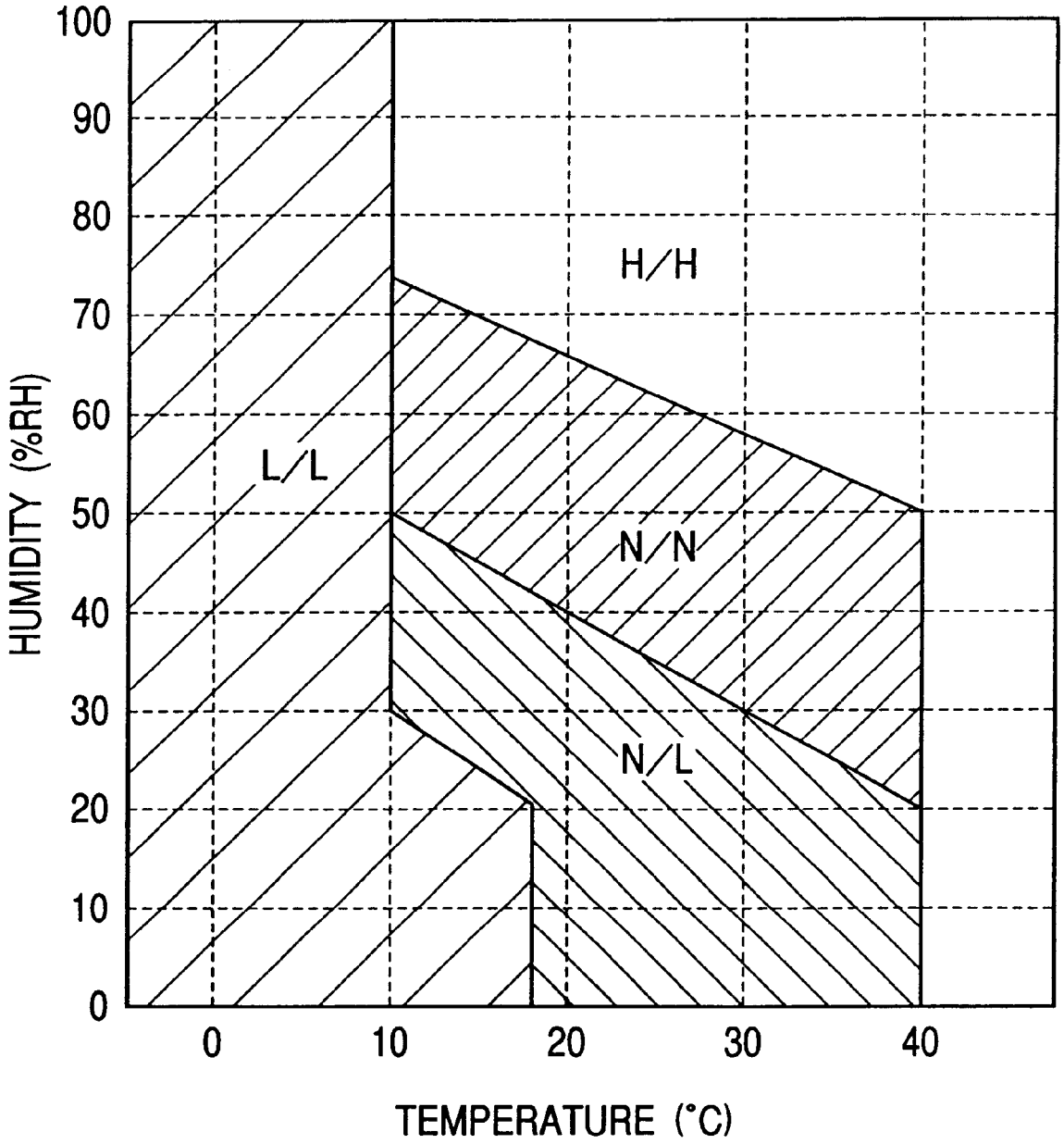
FIG. 4 is an explanatory diagram showing a division of the environment which is used in the control of FIG. 3.

In the embodiment, environmental characteristics zones of the developing characteristics, sensitivity characteristics of the photosensitive drum, and the like are largely divided into four areas in accordance with the temperature and humidity as shown in FIG. 4. In the diagram, an L/L area corresponds to an environment where the low temperature and low humidity environment of (15° C., 10% RH) typically becomes a center or standard. Similarly, an N/L area corresponds to an environment where a normal temperature and low humidity environment of (23° C., 10% RH) becomes the center or standard; N/N corresponds to an environment where a normal temperature and normal humidity environment of (23° C., 50% RH) becomes the center or standard; and H/H corresponds to an environment where a high temperature and high humidity environment of (30° C., 80% RH) becomes the center or standard, respectively.

In the embodiment, the environment is detected by an environmental sensor (temperature sensor and humidity sensor) attached in the image forming apparatus main body and the environment is determined on the basis of the detected temperature data and humidity data with reference to the environment divisions of FIG. 4. As shown in Table 1, the image forming conditions of the developing bias and the primary charging bias adapted to the determined environment are selected in accordance with a previously formed reference table (lookup table) of the developing bias and primary charging bias according to the environment.

Figure 5:
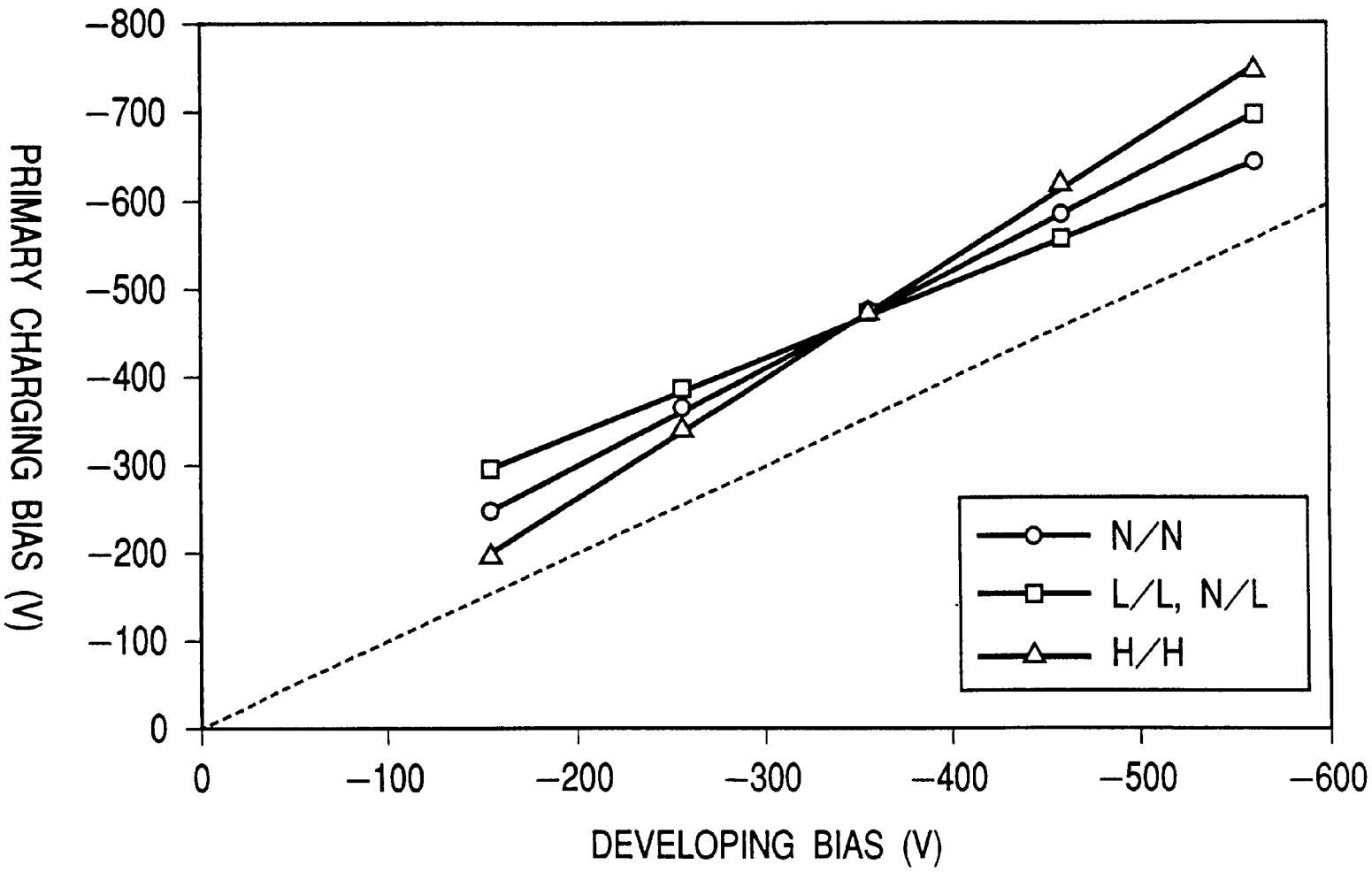
FIG. 5 is a graph showing the contents of a reference table which is used in the control of FIG. 3.

FIG. 5 shows the contents of the reference table. As shown in FIG. 5, an inclination of a straight line (relational expression) showing the relation of the primary charging bias for the developing bias, namely, the relation between the developing bias and the primary charging bias is changed every environment.

In FIG. 5, a broken line shows a straight line of an inclination 1 and is an auxiliary line for enabling a numerical value of the developing bias to be read by a numerical value of the primary charging bias. In Table 1, in addition to the reference table of the developing bias and the primary charging bias, a back contrast potential which is obtained at that time is also written.

TABLE 1

(unit: V)

| developing | primary charging bias | | | back contrast potential | | |
|---|---|---|---|---|---|---|
| bias | N/N | L/L, N/L | H/H | N/N | L/L, N/L | H/H |
| −150 | −250 | −300 | −200 | 100 | 150 | 50 |
| −250 | −363 | −386 | −338 | 113 | 136 | 88 |
| −350 | −475 | −475 | −475 | 125 | 125 | 125 |
| −450 | −588 | −563 | −613 | 138 | 113 | 163 |
| −550 | −700 | −650 | −750 | 150 | 100 | 200 |

In the embodiment, the density control to decide the developing bias and the primary charging bias is performed with reference to the reference table (or relational expression of the straight line) in each environment. The multicolor image formation is performed under the set environment and images are outputted. Thus, in all of the environments, no white gap is generated and no fogged image on background occurs in the boundary portion between the adjacent image portions of different colors.

According to the embodiment as mentioned above, the relational expression of the interlocked change of the developing bias and the primary charging bias is decided and prepared every environment. Therefore, even if the image formation is performed under any environment, the image forming conditions can be properly controlled in accordance with the environment and the image quality can be stably maintained.

Embodiment 3

The embodiment 3 is characterized in that the interlocked change of the primary charging bias for the developing bias is made different in accordance with a use frequency of the developing unit 4.

Since the developing characteristics also change even in dependence on the use frequency or use situation of the developing unit 4, states of generation of the white gap and fogged image on background also change in accordance with those changes. Generally, at the use initial stage of a new developing unit, since developing performance is good, there is no problem. However, as the developing unit is used for a longer time, a frictional charge applying ability of the toner of the developing unit further deteriorates and the developing performance gradually deteriorates. When the developing performance deteriorates, a margin of the back contrast potential for the fogged image on background decreases and a necessity to assure a larger back contrast potential occurs. On the contrary, a smaller back contrast potential is necessary as for the white gap.

In the embodiment, therefore, the number of formed images is counted by the image forming apparatus main body and a use situation of the developing unit 4 is detected. On the basis of the detected use situation of the developing unit, the developing bias and the primary charging bias are set in accordance with a previously formed reference table (shown in Table 2) of the developing bias and the primary charging bias according to the use situation of the developing unit, thereby performing the image formation. As for data of the relation of the developing bias and the primary charging bias of the reference table, for instance, the data corresponding to three stages of the use initial period, middle period, and latter period of the developing unit are formed.

Figure 6:
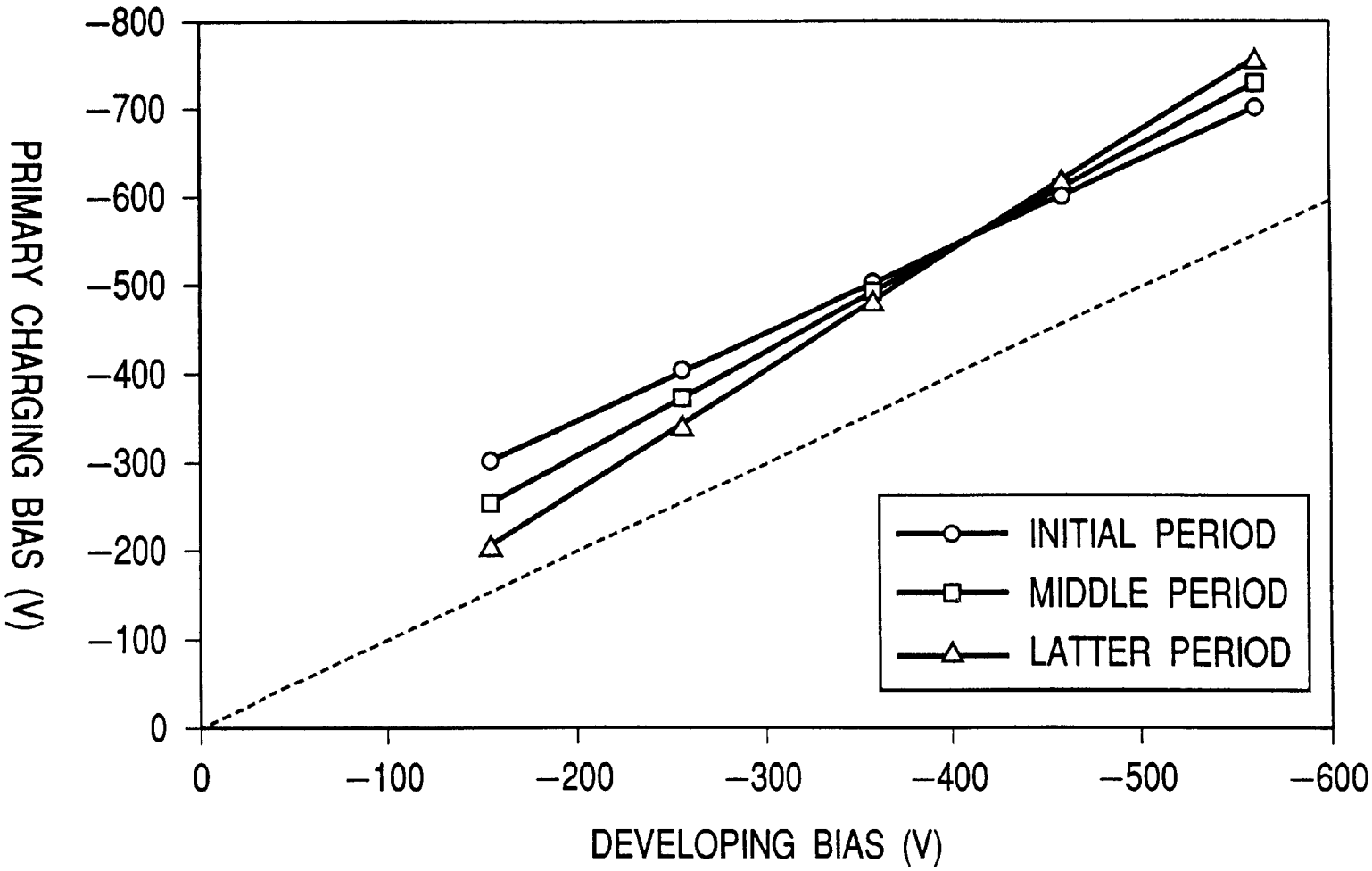
FIG. 6 is a graph showing the contents of a reference table which is used in a control performed in further another embodiment of the invention.

FIG. 6 shows the contents of the reference table. An inclination (relational expression) showing the relation between the developing bias and the primary charging bias is changed every use situation of the developing unit.

TABLE 2

(unit: V)

| developing | primary charging bias | | | back contrast potential | | |
|---|---|---|---|---|---|---|
| bias | (1) | (2) | (3) | (1) | (2) | (3) |
| −150 | −300 | −250 | −200 | 150 | 100 | 50 |
| −250 | −400 | −369 | −338 | 150 | 119 | 88 |
| −350 | −500 | −488 | −475 | 150 | 138 | 125 |
| −450 | −600 | −606 | −613 | 150 | 156 | 163 |
| −550 | −700 | −725 | −750 | 150 | 175 | 200 |

(1): initial period
(2): middle period
(3): latter period

Each time the image formation is performed, the main body of the image forming apparatus accumulates the number of formed images by a counter. Each time the number of formed images is increased by a predetermined number and the use situation of the developing unit advances by only a predetermined degree, the data used so far in the table is updated to data of a new use situation and the developing bias and the primary charging bias are set. When the developing unit is exchanged to a new one, a numerical value of the counter is cleared and the number of formed images is newly counted.

In the embodiment, the density control to set the image forming conditions (developing bias and primary charging bias) in accordance with the use frequency of the developing unit is performed as mentioned above and the image formation is performed under such set conditions. Thus, no white gap is generated until the service life of the developing unit expires and a fogged image on background which will be anxious in the latter half of the service life of the developing unit does not occur as well.

On the other hand, in the case where the control according to the use frequency of the developing unit is not performed in the control of the image forming conditions as in the conventional apparatus, when the developing bias is particularly controlled to a low contrast, a white gap typically appears and as the service life of the developing unit approaches the latter half thereof, a fogged image on background occurs.

In the embodiment, as mentioned above, since the use frequency of the developing unit is detected and the image forming conditions are controlled to the optimum conditions according to the use situation of the developing unit, a stable image quality can be always maintained until the life of the developing unit reaches the expiration.

Embodiment 4

The embodiment 4 is characterized in that the interlocked change of the developing bias and the primary charging bias is made different in dependence on a difference of the developing systems of the developing unit 4.

Developing performance of the developing unit 4 largely changes even in dependence on the developers which are used, a construction of the developing unit, and a developing system and there is a case where changes of developing characteristics of the developing units mixedly exist in one image forming apparatus. For example, there is a case where a color developing unit uses a nonmagnetic developer and a black developing unit uses a magnetic developer, or the like.

In such a case, it is difficult to set them to all of the developing units by using one lookup table of the developing bias and the primary charging bias. To solve such a drawback, it is necessary to hold a plurality of lookup tables due to a difference of the developing system.

In the embodiment, the image forming apparatus uses a non-magnetic one component development system for the color developing units 4*a* to 4*c* and a magnetic one component development system for the black developing unit 4*d*. This is because in case of the nonmagnetic developer, an image after it was fixed is usually glossy and a problem such that it is slightly hard to read a text image such as characters or the like remains. On the other hand, when the magnetic developer is used, an image after the fixing does not have glossiness like glossiness in the case of using the nonmagnetic developer and characters or the like can be also naturally read.

Figure 7:
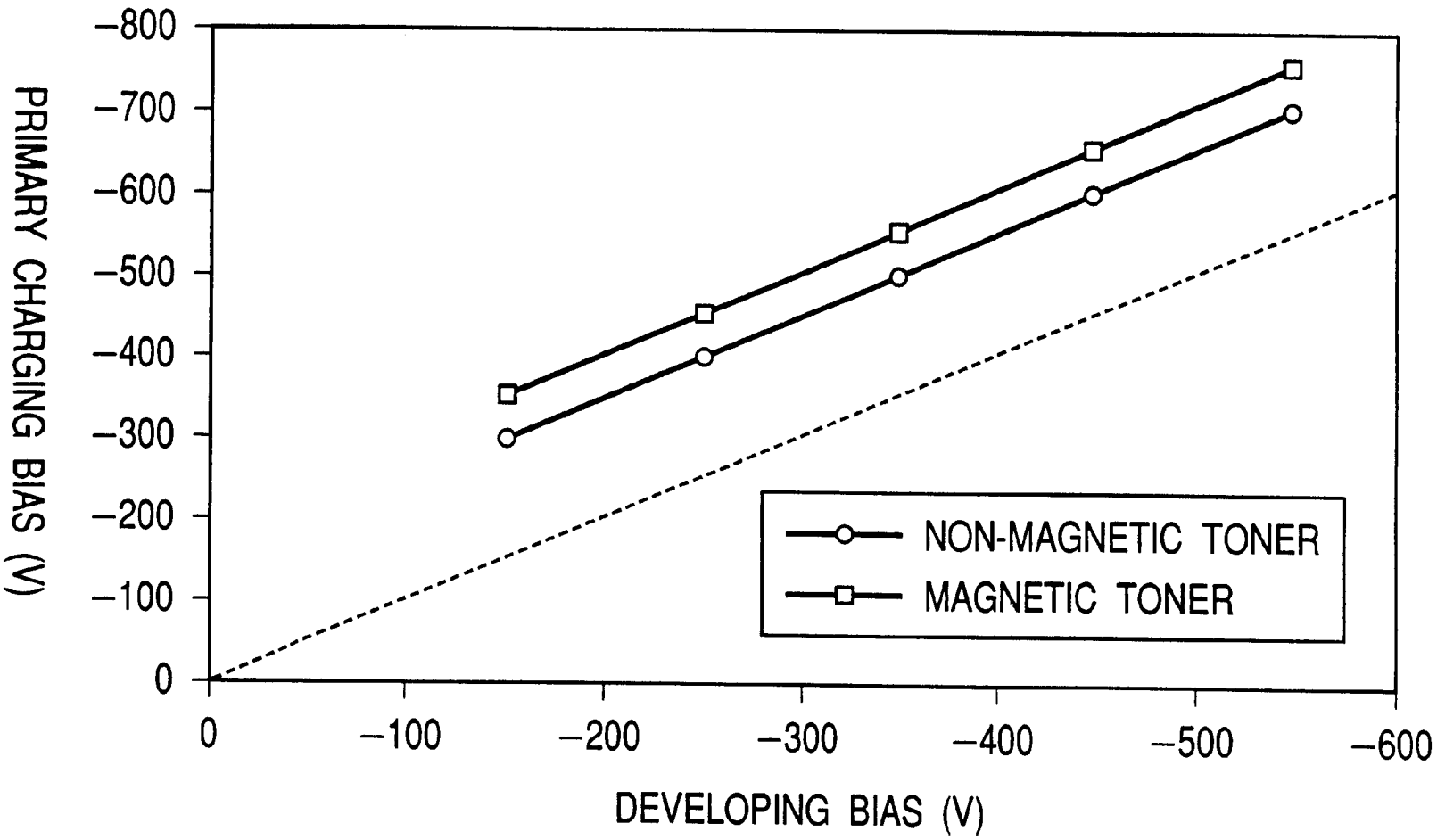
FIG. 7 is a graph showing the contents of a reference table which is used in a control performed in further another embodiment of the invention.

In the embodiment, therefore, a straight line showing the interlocked change relation between the developing bias and the primary charging bias is formed and used as a reference table of a straight line in accordance with a difference of the developing systems as shown in Table 3 and FIG. 7.

TABLE 3

(unit: V)

| | primary charging bias | | back contrast potential | |
|---|---|---|---|---|
| developing bias | non-magnetic | magnetic | non-magnetic | magnetic |
| −150 | −300 | −350 | 150 | 200 |
| −250 | −400 | −450 | 150 | 200 |
| −350 | −500 | −550 | 150 | 200 |
| −450 | −600 | −650 | 150 | 200 |
| −550 | −700 | −750 | 150 | 200 |

As shown in Table 3, in case of the nonmagnetic developer, the back contrast potential is maintained to 150V. In case of the magnetic developer, the back contrast potential is maintained to 200V. This is because no fogged image the background occurs in the developing unit using the magnetic developer.

The image forming conditions according to each developer are set and the density control is performed on the basis of the table and the multicolor image formation is performed. Thus, a good image without a white gap and a fogged image on background is stably obtained.

According to the embodiment, even in the case where the developing system differs as mentioned above, by individually interlocking the image forming conditions with the developing system, an image of a stable quality can be always obtained.

Embodiment 5

The embodiment 5 is characterized in that the interlocked change of the developing bias and the primary charging bias is controlled even for a difference of a color order of the image formation. That is, a lookup table of the interlocked change of the developing bias and the primary charging bias is formed for each of the developing units 4*a* to 4*d* and is used for the density control.

Developing characteristics are not peculiar to all of the developers and, even in case of a nonmagnetic developer, the developing characteristics largely differ depending on a difference of coloring agents, a difference of an externally adding agents, or the like. Therefore, it is important to obtain more optimum image forming conditions by holding a plurality of tables.

In the embodiment, as mentioned above, a table for the interlocked change of the developing bias and the primary charging bias is held for every color. As for the degree of interlocking, a fluctuation width of the back contrast potential is slightly changed depending on the color.

In a manner similar to the embodiments so far, the multicolor image formation is performed and output images are evaluated, so that none of a white gap and a fogged image on background occurs and an image of a good quality is obtained.

According to the embodiment, by controlling the image forming conditions every color, namely, every developing unit, the stable image of a high quality can be always maintained.

As described above, the occurrence of the white gap due to the high back contrast potential and the occurrence of a fogged image on background due to the low back contrast potential can be prevented and a multicolor image of a high quality can be obtained. In the case where the interlocked change of the primary charging bias for the developing bias is made different in accordance with a difference of the environment where the image forming apparatus is installed, the use situation of the developing unit, a difference of the developing system of the developing unit, and further, a difference of colors of the developing units, the quality of an image can be more stabilized.

What is claimed is:

1. An image forming apparatus comprising:

an image bearing member;

charging means for charging said image bearing member, a changeable charging voltage being applied to said charging means;

developing means for developing a latent image formed on said image bearing member, a changeable developing voltage being applied to said developing means; and density detecting means for detecting a density of a developer image developed by said developing means, wherein a plurality of developer images are formed in such a manner that a charging voltage applied to said charging means becomes higher and when a developing voltage applied to said developing means becomes higher, the charging voltage is interlocked with the developing voltage, and densities of the plurality of developer images formed are detected by said density detecting means and, on the basis of detection results, the charging voltage applied to said charging means and the developing voltage applied to said developing means are for image formation are determined.

2. An apparatus according to claim 1, wherein the charging voltage and the developing voltage which are applied when forming the developer image that is detected by said density detecting means differ depending on an environment where said image forming apparatus operates.

3. An apparatus according to claim 1, wherein the charging voltage and the developing voltage which are applied when forming the developer image that is detected by said density detecting means differ depending on a use frequency of said developing means.

4. An apparatus according to claim 1, further has a plurality of developing means for developing the latent images by different kinds of developer.

5. An apparatus according to claim 4, wherein the charging voltage and the developing voltage which are applied when forming the developer image that is detected by said density detecting means differ depending on a kind of the developer.

6. An apparatus according to claim 4, wherein the charging voltage and the developing voltage which are applied when forming the developer image that is detected by said density detecting means differ depending on a developing system of said developing means.

7. An apparatus according to claim 4, wherein the charging voltage and the developing voltage which are applied when forming the developer image that is detected by said density detecting means differ depending on a forming order of the developer images to said image bearing member.

* * * * *

UNITED STATES PATENT AND TRADEMARK OFFICE

CERTIFICATE OF CORRECTION

PATENT NO. : 6,125,245

DATED : September 26, 2000

INVENTOR(S): TAKASHI SHIBUYA, ET AL.

It is certified that error appears in the above-identified patent and that said Letters Patent is hereby corrected as shown below:

COLUMN 6:

Line 56, "on" (first occurrence) should be deleted.

COLUMN 8:

Line 8, "every" should read --in every--.

Line 41, "every" should read --in every--.

COLUMN 10:

Line 49, "the" should read --in the--.

COLUMN 12:

Line 14, "are" (first occurrence) should be deleted.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*